United States Patent [19]

Träubel et al.

[11] 4,106,898

[45] Aug. 15, 1978

[54] LEATHER TANNING WITH OLIGOURETHANES

[75] Inventors: Harro Träubel, Leverkusen, Fed. Rep. of Germany; Helmut Reiff, New Martinsville, W. Va.; Dieter Dieterich, Leverkusen, Fed. Rep. of Germany

[73] Assignee: Bayer Aktiengesellschaft, Leverkusen, Fed. Rep. of Germany

[21] Appl. No.: 718,499

[22] Filed: Aug. 30, 1976

Related U.S. Application Data

[63] Continuation-in-part of Ser. No. 561,809, Mar. 25, 1975, abandoned.

[30] Foreign Application Priority Data

Apr. 4, 1974 [DE] Fed. Rep. of Germany ..... 2416485
Jan. 31, 1975 [DE] Fed. Rep. of Germany ..... 2504081

[51] Int. Cl.[2] ..... C14C 3/18
[52] U.S. Cl. ..... 8/94.33; 8/94.19 C
[58] Field of Search ..... 8/94.19 C, 94.21, 94.33, 8/DIG. 11

[56] References Cited

U.S. PATENT DOCUMENTS

| | | | |
|---|---|---|---|
| 3,374,051 | 3/1968 | Garber | 8/94.21 |
| 3,462,237 | 8/1969 | Sellet | 8/94.21 |
| 3,674,415 | 7/1972 | Sellet | 8/94.33 |
| 3,756,992 | 9/1973 | Dieterich | 260/858 |

FOREIGN PATENT DOCUMENTS

| | | |
|---|---|---|
| 1,223,458 | 1/1959 | France. |
| 1,022,749 | 6/1955 | Fed. Rep. of Germany. |

*Primary Examiner*—John Kight, III
*Attorney, Agent, or Firm*—Gene Harsh; Lawrence S. Dope; Frederick H. Colen

[57] ABSTRACT

This invention is concerned with a method of tanning or retanning leather or pelts by treating them with an aqueous liquor containing hydrophilic oligourethanes. The oligourethanes have a molecular weight of from 300 to 20,000 and they may be methylolated. The oligourethanes may be water soluble owing to their hydrophilic segments. The liquor may also contain up to an equal amount of formaldehyde or compounds which split off formaldehyde.

16 Claims, No Drawings

LEATHER TANNING WITH OLIGOURETHANES

This is a continuation-in-part of copending application Ser. No. 561,809, filed Mar. 25, 1975, now abandoned.

FIELD OF THE INVENTION

This invention relates to a new process for treating, i.e. tanning or retanning leather or animal hide or skin using hydrophilic oligourethanes.

BACKGROUND OF THE INVENTION

German Patent Nos. 878,544 and 889,349 relate to the coating of split leather or the priming of already tanned leather with solutions of a mixture of alkyd resins which contain free hydroxyl groups and isocyanates as cross-linking agents. These patent specifications, however, give no indication as to any tanning effect of reaction products of polyisocyanates and an excess of hydroxyl compounds.

German Patent Nos. 853,438 and 857,425 describe, among other things, the tanning of leather with dispersions, solutions or vapors of low molecular weight polyisocyanates.

These processes generally produce soft leathers which are in many cases, also lightfast, but they are unsuitable in practice because of the toxic properties of low molecular weight diisocyanates.

It has now surprisingly been found that high quality products may be produced without the disadvantage of the previously known tanning processes by treating animal pelts or leather which has been retanned in the conventional manner with an aqueous liquor containing oligourethanes which contain hydrophilic groups.

SUMMARY OF THE INVENTION

The object of this invention is, therefore, a process for tanning or retanning animal hide or skin or leather, which is characterized in that hide, skin or leather are treated with an aqueous liquor which contains:

(a) optionally methylolated hydrophilic oligourethanes which have a molecular weight of from 300 to 20,000; and, optionally, (b) formaldehyde or a substance from which formaldehyde may be split off.

The oligourethanes with a molecular weight of from 300 to 20,000 preferably from 500 to 10,000, used according to the invention contain hydrophilic segments or groups. They are prepared in known manner from polyisocyanates and polyhydroxyl compounds, optionally in the presence of monofunctional chain-terminating agents.

In the context of the present invention, the term "oligourethanes" is defined as compounds having at least two urethane groups, but having no free NCO groups, no aziridine groups and no phenolic groups. The presence of free NCO groups and aziridine groups in tanning agents results in a reduced or shortened pot life of the tanning agents, and the presence of phenolic groups in tanning agents results in a reduction of lightfastness of the treated substrate.

The oligourethanes of the present invention may have terminal groups such as OH and/or $NH_2$, but (when prepared in the presence of monofunctional chain-terminating agents) they may also contain no reactive terminal groups at all. Oligourethanes having at least some terminal OH groups are preferred.

DETAILED DESCRIPTION OF THE INVENTION

The polyisocyanates used as starting materials in the preparation of the oligourethanes may be aliphatic, cycloaliphatic, araliphatic, aromatic or heterocyclic polyisocyanates of the type which have been described, e.g. by W. Siefken in Justus Liebigs Annalen der Chemie, 562, pages 75 to 136, for example, ethylene diisocyanate, tetramethylene-1,4-diisocyanate, hexamethylene-1,6-diisocyanate, dodecane-1,12-diisocyanate, cyclobutane-1,3-diisocyanate, cyclohexane-1,3- and -1,4-diisocyanate and mixtures of these isomers, 1-isocyanato-3,3,5-trimethyl-5-isocyanato-methylcyclohexane, hexahydrotolylene-2,4 and -2,6-diisocyanate and mixtures of these isomers, hexahydrophenylene-1,3- and/or -1,4-diisocyanate, perhydrodiphenylmethane-2,4'- and/or 4,4'-diisocyanate, phenylene-1,3- and -1,4-diisocyanate, tolylene-2,4- and -2,6-diisocyanate and mixtures of these isomers, diphenylmethane-2,4- and/or 4,4'-diisocyanate, naphthylene-1,5-diisocyanate, triphenylmethane-4,4',4''-triisocyanate, polyphenyl-polymethylene-polyisocyanates which may be obtained by aniline-formaldehyde condensation followed by phosgenation and which have been described, e.g. in British Pat. Specification Nos. 874,430 and 848,671, the diisocyanates according to U.S. Pat. No. 3,492,330, polyisocyanates which contain allophanate groups as described, e.g. in British Pat. Specification No. 994,890, Belgian Pat. No. 761,626 and published Dutch Patent Application No. 7,102,524, polyisocyanates which contain isocyanurate groups as described, e.g. in German Pat. Nos. 1,022,789; 1,222,067 and 1,027,394 and in German Offenlegungsschriften Nos. 1,929,034 and 2,004,048, polyisocyanates which contain urethane groups as described, e.g. in Belgian Pat. No. 752,261 or in U.S. Pat. No. 3,394,164, polyisocyanates which contain acylated urea groups according to German Pat. No. 1,230,778, polyisocyanates which contain biuret groups as described, e.g. in German Pat. No. 1,101,394, in British Pat. Specification No. 889,050 and in French Pat. No. 7,017,514, polyisocyanates prepared by telomerization reactions, e.g. according to Belgian Pat. No. 723,640, polyisocyanates which contain ester groups as mentioned, e.g. in British Pat. Specification Nos. 956,474 and 1,072,956, in U.S. Pat. No. 3,567,763 and in German Pat. No. 1,231,688 and reaction products of the above-mentioned isocyanates with acetals according to German Pat. No. 1,072,385. Mixtures of the above-mentioned polyisocyanates may also be used. Aliphatic and cycloaliphatic polyisocyanates are preferred because of their light fastness. Hexamethylene-1,6-diisocyanate, tetramethylene -1,4-diisocyanate, the cyclohexane diisocyanate isomers and 1-isocyanato-3,3,5-trimethyl-5-isocyanatomethyl-cyclohexane are particularly preferred.

Suitable polyhydroxyl compounds for preparing the oligourethanes used according to the invention, apart from short chain polyesters and polycarbonates, are mainly polyethers with a molecular weight of from 100 to 3000, preferably from 100 to 1000, which contain at least 2, generally 2 to 8 but preferably 2 or 3 hydroxyl groups. They may be prepared conventionally e.g. by polymerizing epoxides, such as ethylene oxide, propylene oxide, butylene oxide, tetrahydrofuran, styrene oxide or epichlorohydrin, each with itself, e.g. in the presence of $BF_3$, or by the addition of these epoxides, optionally as mixtures or successively, to starting components which contain reactive hydrogen atoms, such as water, alcohols or amines, e.g. ethylene glycol, propylene-1,3- or -1,2-glycol, trimethylolpropane, 4,4'-dihydroxydiphenylpropane, aniline, ammonia, ethanolamine or ethylene diamine. Polyethers modified with vinyl polymers, e.g. the compounds obtained by polymerizing styrene and acrylonitrile in the presence of polyethers (U.S. Pat. Nos. 3,383,351; 3,304,273; 3,523,093 and 3,110,695 and German Pat. No. 1,152,536) and polybutadienes which contain OH groups are also suitable. It is preferred, however, to use polyethers which contain at least 50% by weight of ethylene oxide units.

Suitable polyesters with hydroxyl groups include, e.g. the reaction products of polyvalent, preferably divalent, alcohols, with the optional addition of trivalent alcohols, and polybasic, preferably dibasic, carboxylic acids. Instead of the free polycarboxylic acids, the corresponding polycarboxylic acid anhydrides or esters with lower alcohols or mixtures thereof may be used for preparing the polyesters. The polycarboxylic acids may be aliphatic, cycloaliphatc, aromatic and/or hetercyclic and may be substituted, e.g. with halogen atoms, and/or may be unsaturated. The following are examples: oxalic acid, malonic acid, succinic acid, adipic acid, suberic acid, azelaic acid, sebacic acid, phthalic acid, isophthalic acid, trimellitic acid, phthalic acid anhydride, tetrahydrophthalic acid anhydride, hexanhydrophthalic acid anhydride, tetrachlorophthalic acid anhydride, endomethylene tetrahydrophthalic acid anhydride, glutaric acid anhydride, maleic acid, maleic acid anhydride and fumaric acid. The following are examples of suitable polyhydric alcohols used either separately or as mixtures: ethylene glycol, propylene-1,2- and -1,3-glycol, butylene-1,4- and -2,3-glycol, hexane-1,6-diol, octane-1,8-diol, neopentylglycol, cyclohexane dimethanol (1,4-bis-hydroxymethylcyclohexane), 2-methyl-1,3-propane-diol, glycerol, trimethylolpropane, hexane-1,2,6-triol, butane-1,2,4-triol, trimethylolethane, pentaerythritol, diethyleneglycol, triethyleneglycol, tetraethyleneglycol, polyethyleneglycols, dipropyleneglycol, polypropyleneglycols, dibutylene glycol and polybutylene glycols. The polyesters may also contain a proportion of carboxylic end groups. Polyesters of lactones, such as $\epsilon$-caprolactone, or hydroxycarboxylic acids, such as $\omega$-hydroxycaproic acid, may also be used. Short chain hydrophilic polyesters (molecular weight from 178 to 3000, preferably from 178 to 1000) are preferred according to the invention.

The polycarbonates with hydroxyl groups used may be those known per se, for example, those which may be obtained by reacting diols, such as propane-1,3-diol, butane-1,4-diol and/or hexane-1,6-diol, ethylene glycol, diethyleneglycol, triethyleneglycol, or tetraethyleneglycol, with diarylcarbonates, e.g. diphenylcarbonate or phosgene. They have a molecular weight of from 150 to 3000, preferably from 150 to 1000. Polyhydroxyl compounds which already contain urethane or urea groups and modified or unmodified natural polyols, such as castor oil, carbohydrates or starch, may also be used.

Representatives of these compounds used according to the invention have been described, e.g. in the High Polymers, Vol. XVI, "Polyurethanes, Chemistry and Technology", published by Saunders-Frisch, Interscience Publishers, New York, London, Volume I, 1962, pages 32–42 and pages 44–54 and Volume II, 1964, pages 5–6 and 198–199 and in Kunststoff-Handbuch, Volume VII, Vieweg-Hochtlen, Carl-Hanser-Verlag, Munich 1966, e.g. on pages 45 to 71.

The oligourethanes may be methylolated in conventional manner by means of formaldehyde, paraformaldehyde, formalin solutions, semiacetals of formaldehyde or other substances which split off formaldehyde, optionally in the presence of basic inorganic or organic methylolating catalysts.

Similarly hydrophobic polyhydroxy compounds may be used in combination with non-ionic hydrophilic polyhydroxyl compounds, e.g. oligo ethylene glycols.

In a preferred embodiment of the invention monofunctional chain-terminating agents are employed to synthesize the oligourethanes to be used in accordance with the invention, such as alcohols, amines, carboxylic acids, or ureas, e.g. methanol, ethanol, propanol, isopropanol, glycol monomethyl ether, dimethyl amine, diethyl amine, methyl amine, ethyl amine, urea, ethylene urea, acetic acid, lactic acid, glycide, 3-hydroxymethyl-3-ethyl-oxetane,2-chloro-ethanol, trichloroethanol, 2,3-dibromo-1-propanol, 1-chloro-2-propanol, 1,3-dichloro-2-propanol, acetamide, chloro-acetamide, chloro-acetic acid, lauric acid, coconut fatty acid, dodecanic acid, stearic acid, oleic acid, stearyl alcohol or diethylene glycol-monomethyl ether.

Bifunctional or higher functional alcohols, aminoalcohols or amines, which are known to the polyurethane expert under the heading of "chain lengthening agents" can likewise be used as chain-terminating agents to synthesize oligourethanes as long as diisocyanate is used in a stoichiometrically deficient quantity so that these compounds substantially react monofunctionally only. There made be mentioned by way of example: diethylene glycol, triethylene glycol, tetraethylene glycol, dipropylene glycol, thiodiglycol, trimethylol propane, glycerine, and amino ethanol. Mono-isocyanates, e.g. methyl isocyanate, butyl isocyanate or stearyl isocyanate can at the same time be used as chain terminating agents.

On the other hand products which form milky-white dispersions of hydrophobic character in water, are generally less suitable according to the invention.

Oligourethanes which are particularly suitable for use in accordance with the invention contain about 40% by weight (based on total oligourethane) of hydrophilic polyethers, have a molecular weight of about 500 to 3000 and yield a clear or turbid solution on dissolving in water.

The optimum weight ratios of the components in the preparation of oligourethanes are preferably determined empirically while paying regard to the required tanning effect and sufficient liquor stability.

A NCO/OH ratio of about 0.4 to 0.8, preferably 0.5 to 0.7, is maintained when synthesizing oligourethanes from exclusively bifunctional components, e.g. polyethers and diisocyanates in order to achieve the desired low molecular weight. If monofunctional chain terminating agents are simultaneously used, the NCO/OH ratio amounts to about 0.6 to 1.0, preferably 0.7 to 0.9.

Products are also preferred which are easily water-soluble or at least water-miscible before methylolation.

The products should have marked hydrophilic qualities particularly in the case of the preferred low molecular weights of 500 to 3000. In the case of high molecular weights sufficiently finely divided and stable dispersions are still obtained with products of less hydrophilic character.

The oligourethane tanning substances to be used in accordance with the invention have the particular advantage of being easy to obtain and economic to produce. They can be very simply made from low-costing products prepared on a large scale, e.g. by stirring the components together in vessels at room temperature.

The tanning effect is not dependent on the presence of free or chemically-bonded formaldehyde. However, it is frequently observed that such oligourethanes which exhibit distinct tanning activity without modification with formaldehyde, exhibit still greater tanning activity after formaldehyde modification. It is thus preferred to combine such oligourethanes with formaldehyde.

According to the invention, the oligourethanes may be used in the form of aqueous dispersions with average particle sizes of less than 200 mμ. Aqueous sols with particles having diameters of less than 50 mμ are more preferred but water-soluble oligourethanes are particularly preferred.

In addition to the optionally methylolated hydrophilic oligourethanes, the aqeous tanning liquors according to the invention may contain from 0 100% by weight, preferably from 0.5 to 30% by weight, based on the oligourethane solids content, of formaldehyde or compounds which split off formaldehyde. It is an advantage of the process according to the invention, however, that the desired tanning effect in many cases may be obtained even without the use of formaldehyde or methylolated products.

According to the invention, the hides, skins and leathers may be treated with the tanning liquor by means of any conventional tanning apparatus, preferably in a drum or in a dyeing machine with Y-shaped, perforated separating walls such as a CORETAN (trade mark) machine by USM. Depending on the kind of hide, the tanning agent and the desired tanning effect, the materials are treated with the tanning liquor for about 0.5 hours to about 3 days. The liquors may also be applied by spraying, dipping or curtain coating, however.

It is an advantage of the oligourethanes to be used in accordance with the invention that they are not sensitive against variations of the pH-value. Thus, the liquors may have a pH-value from about 2.5 to 9, preferably 3 to 8 and with particular preference from 3.5 to 6.

The oligourethanes also are not sensitive against elevated temperatures. When being used as retanning agents, or dyeing auxiliaries, they therefore may be applied at temperatures of up to about 80° C. On the other hand, since hides and skins must not be heated above their denaturation temperature, tanning has to be carried out at temperatures below about 30° C, preferably at room temperature.

The leathers obtained according to the invention generally have a low specific gravity since the fibers are not heavily loaded with tanning substance.

In contrast to conventionally produced suedes (which they resemble in their properties), the leather obtained according to the invention may easily be dyed with ordinary dyes. The tanning agents in accordance with the invention act advantageously at the same time as dyeing auxiliaries. The dyeing agents are particularly uniform absorbed on leather which has been treated with the products in accordance with the invention. No undesired brightening occurs. As the products are lightfast no change in color is to be detected on exposure to light. Leathers which have been tanned according to the invention may be dressed by any conventional dressing methods. They are supple, gentle to the skin, porous, soft, white and lightfast. Since they are white, they may be dyed in brilliant colors.

Unless otherwise stated, the figures quoted in the Examples represent parts by weight and % by weight, respectively.

EXAMPLE 1 a. Preparation of the oligourethanes:

400 g of nona-ethyleneglycol (1 mol) were dehydrated and mixed with 151 g of hexamethylene-1,6-diisocyanate (0.9 mol) at 70° C. The reaction mixture was heated to 120° C in the course of one hour and then stirred at this temperature for a further 5 hours. After the addition of 5 ml of dimethylaminoethanol, the reaction mixture no longer showed any NCO bands in the IR spectrum. 1285 ml of water was then added dropwise. A 30% solution of oligourethane with a pH of 7.5 was obtained. 3.3 g of a 30% aqueous formaldehyde solution were added to 100 g of this oligourethane solution.

b. Process according to the invention:

A chrome tanned neat's leather was neutralized to pH 4.5 with a 1% solution of calcium formate. The leather was then treated for 3 hours at 20° C with the above-described product which had been diluted to a solids content of 3% by weight with 10 times its quantity of water. The pH was then 4.3. A slightly fuller, very soft retanned leather was obtained.

EXAMPLE 2

A limed cattle hide was treated in a drum with the formaldehyde containing aqueous oligourethane liquor described in Example 1. The final pH was 5.9. A full, soft and lightfast (up to Blue scale 6) nappa leather with a shrinkage temperature of 95° C was obtained.

EXAMPLE 3 a. Preparation of the oligourethane:

600 g of octaethyleneglycol were dehydrated and 168 g of hexamethylene-1,6-diisocyanate were added at 45° C. The reaction mixture was heated to 90°-120° C, and a strongly exothermic reaction occurred. It was then stirred for 90 minutes at 90° C. After the addition of 6 ml of dimethyl-aminoethanol the IR spectrum no longer showed any NCO bands. 1790 ml of water were then added dropwise. A 30% aqueous oligourethane solution with pH 8 was obtained.

b. Process according to the invention:

A pickled calf skin was treated with 10 percent by weight of the oligourethane solution described above and tanned in a shaker frame for 48 hours at 20° C. The leather was then rinsed and finally fat liquored for one hour at 40° C with 50 parts of water and 50 parts of a dubbing mixture consisting of 45 parts of sulphonated sperm oil, 45 parts of a sulphonated chloroparaffin and 10 parts of a sulphonated neat's foot oil and it was then fleshed and dried in air. A white, lightfast leather was obtained which had a shrinkage temperature of over 70° C.

EXAMPLE 4 a. Preparation of the oligourethane 394 g of anhydrous octa-ethylene glycol (1 mol) and 19.2 g of methanol (0.6 mol) were treated in the course of 1 hour at room temperature with 134.5 g of 1,6-diisocyanatohexane (0.8 mol), the temperature rising to 65° C. Stirring was continued for a further 2 hours at approximately 60° C until an IR spectrum no longer showed any NCO bands. Thereafter the reaction product was diluted with 447 g of water, treated with 65 g of 37% aqueous formaldehyde solution and stirred at room temperature for another 5 hours.

b. Process in accordance with the invention (1) Use as tanning agent alone: A calf pelt, which has been limed and delimed in the usual way, was drummed for 24 hours at 20° C with 100% by weight of water and 10% of oligourethane (dry substance). Thereafter the leather was washed for 10 minutes, fleshed and, without greasing, hung up to dry.

Evaluation:

The leather has a very soft handle, is full, white in color and very lightfast.

Shrinkage temperature: 90° C.

(2) Use as retanning agent for chrome leather: Leather, which has been tanned in the customary manner with trivalent chrome sulphate salts, was treated at 40° C with 100% water and 5% dry substance of the oligourethane.

Drumming time: 2 hours

Thereafter the leather was fat-liquored with 2% of sulphonated neatsfoot oil and then hung to dry.

Evaluation:

By aftertreatment with the above product, the color of the chrome leather is somewhat brighter and the handle softer and fuller than without such aftertreatment.

(3) Use of the products as dyeing auxiliary: Chrome leather, which has been dyed as in Example 2, was drummed for 2 hours with 5% dry substance of oligourethane, then rinsed for 5 minutes at 50° C and dyed with the following liquor:

500% water (60° C)

0.5% anionic, acid-resistant dyestuff

Drumming time: 1 hour

Thereafter the leather was rinsed for 5 minutes, fleshed and hung to dry.

Evaluation of dyeing:

It was shown that aftertreatment with oligourethane favorably influences the dyeability of the chrome leather. The brightening effect is considerably less than with the known commercially available dyeing auxiliaries used especially for this purpose.

EXAMPLE 5

Work is carried out as in Example 4, except that the oligourethane is not modified with formaldehyde.

This product also exhibits good tanning activity even if to a lesser extent than in Example 4.

EXAMPLES 6–15

Work is carried out analogously to Example 4 except that different chain terminating agents are used. The approximately 50 to 60% aqueous solutions or sols which are obtained are tested analogously to Example 4 for tanning activity. The results can be seen from the Table:

++ means good tanning activity

+ moderately good

| Example | octa-ethylene-glycol (mol) | 1,6-diiso-cyanatohexane (mol) | Chain-terminating agent | (mol) | Formal-dehyde (mol) | Tanning Ac-tivity |
|---|---|---|---|---|---|---|
| 6 | 0.94 | 1.3 | 3-ethyl-3-hydroxy-methyl-oxetane | 0.6 | 1.3 | ++ |
| 7 | 1.0 | 2.0 | methanol | 2.0 | 2.0 | ++ (instable liquor) |
| 8 | 1.0 | 1.2 | diethylene glycol | 0.6 | — | + |
| 9 | 1.0 | 1.2 | diethylene glycol | 0.6 | 1.2 | + (as 9) |
| 10 | 1.0 | 1.0 | ethylene urea | 1.0 | — | + |
| 11 | 1.0 | 1.0 | ethylene urea | 1.0 | 1.0 | + (as 11) |
| 12 | 1.0 | 1.3 | glycide | 0.6 | — | ++ |
| 13 | 1.0 | 1.3 | glycide | 0.6 | 1.3 | ++ |
| 14 | 0.94 | 1.3 | diethylene glycol-mono-methyl ether | 0.6 | — | (+) |
| 15 | 0.94 | 1.3 | diethylene glycol-mono-methyl ether | 0.6 | 1.3 | + |

EXAMPLE 16

Work is carried out as in Example 4 except that 1,6-diisocyanatohexane is replaced by 178 g (0.8 mol) of 1-isocyanato-3,3,5-trimethyl-5-isocyanatomethyl-cyclohexane.

A product is likewise obtained with excellent tanning properties.

EXAMPLE 17

Work is carried out as in Example 4 except that 1,6-diisocyanatohexane is replaced by 139 g of tolylene diisocyanate (isomer ratio 65/35).

This product likewise has good tanning activity. The tanning however is not lightfast.

The tanning activity of this product can be further improved by partial replacement of the tolylene diisocyanate by sulphonated tolylene diisocyanate.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. Process for tanning or retanning hide, skin or leather, characterized in that hide, skin or leather are treated with an aqueous liquor which contains:

(a) optionally methylolated hydrophilic oligourethanes which have a molecular weight of from 300 to 20,000, characterized in that the oligourethanes have no free NCO groups, no aziridine groups, no phenolic groups, and no ionic groups; and, optionally, (b) formaldehyde or a substance from which formaldehyde may be split off.

2. Process according to claim 1, characterized in that the oligourethane molecule contains hydrophilic polyether segments.

3. A process for tanning or retanning a substrate selected from the group consisting of animal pelts and leather comprising treating the substrate with an aqueous liquor containing hydrophilic oligourethanes which have a molecular weight ($M_n$) of from 300 to 20,000, characterized in that the oligourethanes have no free NCO groups, no aziridine groups, no phenolic groups, and no ionic groups.

4. The process of claim 3 wherein the oligourethanes are methylolated.

5. The process of claim 4 wherein the aqueous liquor contains from 0 to 100 wt. % based on oligourethane solids of compounds selected from the group consisting of formaldehyde and compounds which split off formaldehyde.

6. The process of claim 5 wherein the formaldehyde supplying compounds are present in amounts of about 0.5 to 30 wt. % based on oligourethane solids.

7. The process of claim 3 wherein the oligourethanes are present in the form of an aqueous dispersion with an average particule size of less than about 200 mμ.

8. The process of claim 3 wherein the oligourethanes are water soluble.

9. A process for tanning or retanning a substrate selected from the group consisting of animal pelts and leather comprising treating the substrate with an aqueous liquor containing hydrophilic oligourethanes which have a molecular weight ($M_n$) of from 300 to 20,000 and contain no free NCO groups, no aziridine groups, no phenolic groups, and no ionic groups, said hydrophilic oligourethanes synthesized by a process comprising:

(a) reacting polyhydroxyl compounds selected from the group consisting of polyethers, polyesters and polycarbonates with (b) polyisocyanates, and (c) optionally chain-terminating agents.

10. The process of claim 9 wherein the NCO/OH ratio maintained during the synthesis of the hydrophilic oligourethanes is between 0.4 to 0.8.

11. The process of claim 9 wherein chain-terminating agents selected from the group consisting of polyols, amino alcohols and polyamines are used in the synthesis of the hydrophilic oligourethanes and wherein the NCO/OH ratio maintained during the synthesis reaction is between 0.4 to 0.8.

12. The process of claim 9 wherein chain-terminating agents selected from the group consisting of monofunctional alcohols, monofunctional amines, monofunctional carboxylic acids, urea and monofunctional isocyanates are used in the synthesis of the hydrophilic oligourethanes and wherein the NCO/OH maintained during the synthesis reaction is between 0.6 to 1.0.

13. The process of claim 12 wherein the chain-terminating agents are selected from the group consisting of monofunctional alcohols, monofunctional amines, monofunctional carboxylic acids and urea.

14. The process of claim 9 wherein chain-terminating agents are used in the synthesis of the hydrophilic, oligourethanes, at least one of said chain-terminating agents selected from the group consisting of polyols, amino alcohols and polyamines.

15. The process of claim 9 wherein the polyhydroxyl compounds are polyethers.

16. The process of claim 15 wherein the polyethers contain at least 50% by weight of ethylene oxide units and have a molecular weight of about 100 to 3,000.

* * * * *